US009506182B2

(12) United States Patent
Park et al.

(10) Patent No.: US 9,506,182 B2
(45) Date of Patent: Nov. 29, 2016

(54) CLOTHES TREATING APPARATUS WITH STEAM GENERATOR

(71) Applicant: LG ELECTRONICS INC., Seoul (KR)

(72) Inventors: Daeyun Park, Seoul (KR); Sungmin Kim, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/606,413

(22) Filed: Jan. 27, 2015

(65) Prior Publication Data

US 2015/0211169 A1 Jul. 30, 2015

(30) Foreign Application Priority Data

Jan. 28, 2014 (KR) ..... 10-2014-0010818

(51) Int. Cl.

| | |
|---|---|
| ***D06F 17/12*** | (2006.01) |
| ***D06F 29/00*** | (2006.01) |
| ***D06F 39/00*** | (2006.01) |
| ***D06F 39/12*** | (2006.01) |
| ***D06F 71/34*** | (2006.01) |
| ***D06F 87/00*** | (2006.01) |
| ***D06F 58/04*** | (2006.01) |

(52) U.S. Cl.

CPC ..... *D06F 39/008* (2013.01); *D06F 17/12* (2013.01); *D06F 29/00* (2013.01); *D06F 39/12* (2013.01); *D06F 58/04* (2013.01); *D06F 71/34* (2013.01); *D06F 87/00* (2013.01)

(58) Field of Classification Search

CPC ..... D06F 17/12; D06F 29/00; D06F 39/008; D06F 39/12; D06F 71/34; D06F 87/00

USPC ..... 68/5 R, 5 C, 207, 222

See application file for complete search history.

(56) References Cited

U.S. PATENT DOCUMENTS

2007/0283506 A1* 12/2007 Wong ..... D06F 35/006 8/149.3

2010/0064736 A1* 3/2010 Jeong ..... D06F 29/00 68/13 R

* cited by examiner

*Primary Examiner* — Michael Barr

*Assistant Examiner* — Levon J Shahinian

(74) *Attorney, Agent, or Firm* — Dentons US LLP

(57) ABSTRACT

A clothes treating apparatus includes a laundry keeping unit including at least one tray with a plurality of through holes formed thereon. A steam generator is detachably installed in the laundry keeping unit and configured to jet steam to the at least one tray. When the laundry is partially contaminated, steam may be concentratively jetted to the contaminated portion.

14 Claims, 6 Drawing Sheets

CLOTHES TREATING APPARATUS WITH STEAM GENERATOR

CROSS-REFERENCE TO RELATED APPLICATION

Pursuant to 35 U.S.C. §119(a), this application claims the benefit of earlier filing date and right of priority to Korean Application No. 10-2014-0010818, filed on Jan. 28, 2014, the contents of which is incorporated by reference herein in its entirety.

BACKGROUND OF THE INVENTION

1. Field of the Invention

The present disclosure relates to a clothes treating apparatus, and more particularly, to a clothes treating apparatus including a steam generator.

2. Background of the Invention

In general, a clothes treating apparatus (such as a washing machine, a washing machine having a drying function, or a dryer) includes a drum into which the laundry is introduced. A washing machine further includes a tub accommodating washing water, and a drum is rotatably installed within the tub.

The clothes treating apparatus may further include a steam generator to supply steam to the drum when washing or drying the laundry. However, in the related art clothes treating apparatus having a steam generator, the drum is relatively large and the position where a steam injection nozzle may be installed is limited, and it is difficult to direct jet steam to a desired portion of the laundry.

In addition, in the related art clothes treating apparatus including a steam generator, since the steam generator is fixedly installed within a cabinet and steam is jetted only to the interior of the drum, steam cannot be utilized outside of the cabinet.

SUMMARY

One object of the detailed description is to provide a clothes treating apparatus capable of jetting steam to a portion of the laundry.

Another object of the detailed description is to provide a clothes treating apparatus capable of providing steam to a contaminated or desired portion of the laundry, thus enhancing washing efficiency.

Another object of the detailed description is to provide a clothes treating apparatus which can be simply installed in an existing washing machine, dryer, any other laundry treating device, or a container of the laundry, and supply steam to the container of the laundry.

To achieve these and other objects and advantages and in accordance with the purpose of this specification, as embodied and broadly described herein, a clothes treating apparatus may include: a laundry keeping or holding unit including at least one tray with a plurality of through holes formed thereon; and a steam generator detachably installed in the laundry keeping unit and configured to jet steam to the at least one tray.

In the configuration described above, a user may put or place the laundry on the tray and jet steam to a desired portion of the laundry. Also, in the configuration described above, when the steam generator is intended to be used, the steam generator may be separated from the laundry keeping unit.

The steam generator may include: a steam generating unit having a space for accommodating water and including a heater to heat water to generate steam; a case including the steam generator provided therein and formed to be grasped; and a steam injecting unit provided in the case and configured to communicate with the steam generator to jet steam to the outside.

The washing keeping unit may further include a condensation collecting unit installed below the at least one tray. Here, a lower surface of the condensation collecting unit may be formed to be sloped toward a drain hole to allow condensation to easily flow to the drain hole.

The laundry keeping unit may further include: a steam generator receiving unit configured to allow the steam generator to be detachably installed therein, wherein the steam generator receiving unit has an insertion hole formed on a lower surface thereof to allow an injection nozzle of the steam generator to be inserted therein.

The laundry keeping unit may further include a steam injection pipe configured to communicate with the insertion hole and to extend from the insertion hole to a lower surface of the washing keeping unit through the laundry keeping unit.

In the configuration described above, even when the steam generator is installed in the steam generator receiving unit, the injection nozzle of the steam generator may supply steam to the steam injection pipe through the insertion hole. Thus, the laundry keeping unit with the steam generator installed therein may be installed in an upper portion of a container in which the laundry is present, to supply steam to the laundry within the container.

To achieve these and other advantages and in accordance with the purpose of this specification, as embodied and broadly described herein, a clothes treating apparatus may include: a cabinet; a drum rotatably installed within the cabinet; a driving unit configured to rotatably drive the drum; a water supply unit configured to supply washing water to the drum; a draining unit configured to drain washing water from within the drum; a laundry keeping unit installed in the cabinet and including at least one tray with a plurality of through holes formed thereon; and a steam generator provided outside of the cabinet and configured to jet steam to the laundry keeping unit.

In the configuration described above, since the steam generator is provided outside of the clothes treating apparatus in which a drum is rotatably installed, the steam generator may be used for multiple purposes.

The laundry keeping unit may be provided on an upper part of the cabinet. In the aspect of the configuration described above, the laundry may be put on the laundry keeping unit and locally steamed, and thereafter, the laundry may be simply introduced to the drum.

The laundry keeping unit may further include: a condensation collecting unit installed below the at least one tray. The laundry keeping unit may further include a drain unit configured to communicate with the condensation collecting unit, and the drain unit may be connected to the draining unit to simply discharge condensation collected by the condensation collecting unit.

The steam generator may include: a steam generating unit having a space for accommodating water and including a heater to heat water to generate steam; a case including the steam generator provided therein and formed to be grasped; and a steam injecting unit provided in the case and configured to communicate with the steam generator to jet steam to the outside.

The water supply unit may include a water supply hose configured to extend to the outside of the cabinet to supply water to the steam generating unit, whereby water may be simply received from the water supply unit installed in the cabinet.

The steam generator may further include a plurality of partitions configured to partition the space for accommodating water, wherein the plurality of partitions may be alternately disposed such that a flow of water may be changed a plurality of times, to thus form an elongated flow path within the space for accommodating water.

Also, the steam generating unit may further include a plurality of electric heating protrusions formed between the plurality of partitions and provided to receive heat from the heater, thus increasing a heat transmission area. Thus, water flowing along the flow path formed extendedly by the partitions, may be rapidly heated to generate steam and the steam may be jetted through the steam injection unit at high pressure.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Figure 1:
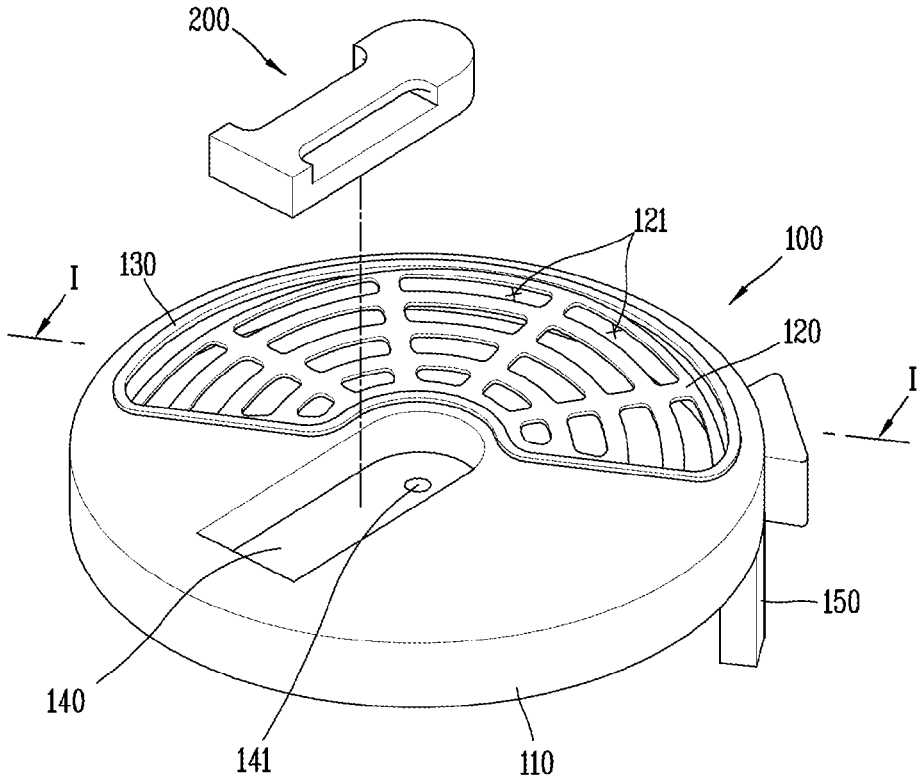
FIG. 1 is a perspective view illustrating a first embodiment of a clothes treating apparatus having a steam generator according to the present disclosure.
Figure 2:
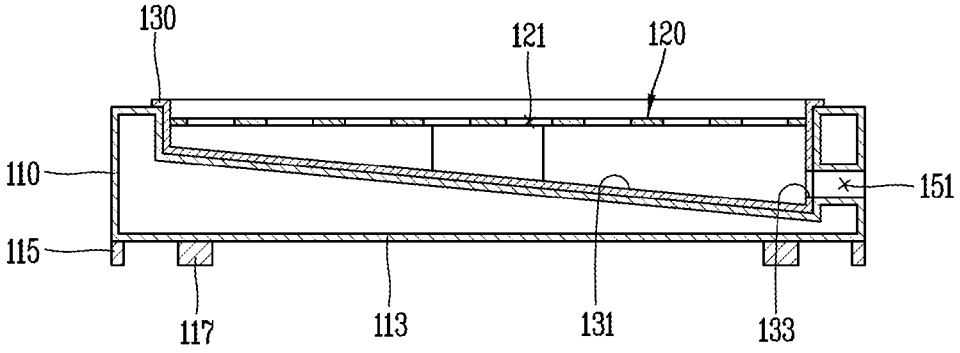
FIG. 2 is a cross-sectional view taken along line I-I of FIG. 1.
Figure 3:
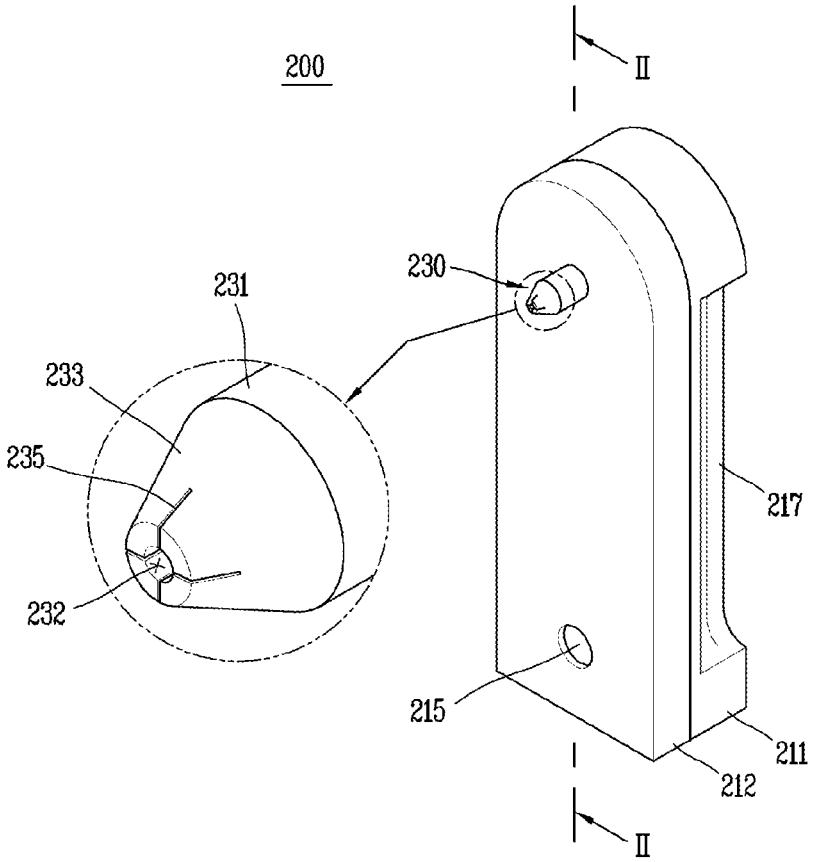
FIG. 3 is a perspective view of the steam generator of the embodiment in FIG. 1.

Hereinafter, embodiments will be described in detail with reference to the accompanying drawings such that they can be easily practiced by those skilled in the art to which the present invention pertains. In describing embodiments of the present invention, if a detailed explanation for a related known function or construction is considered to unnecessarily divert the gist of the present invention, such explanation will be omitted but would be understood by those skilled in the art.

A clothes treating apparatus including a steam generator according to an embodiment of the present disclosure includes a laundry keeping unit 100 and a steam generator 200. The clothes treating apparatus including a steam generator according to an embodiment of the present disclosure will be described in detail with reference to FIGS. 1 through 5.

The laundry keeping unit 100 may keep an item to be washed, and detachably receive the steam generator 200 therein. The laundry keeping unit 100 may include a keeping case 110, a tray 120 and a condensation collecting unit 130 installed in the keeping case 110, a steam generator receiving unit 140 where the steam generator is received, and a drain unit 150 through which condensation collected by the condensation collecting unit is drained.

The keeping case 110 has a hollow cylindrical shape, and has a recess extending downwardly to have a predetermined depth, allowing the tray 120 and the condensation collecting unit 130 to be installed therein. The steam generator receiving unit 140 is formed as a recess on an upper surface of the keeping case 110 and allows the steam generator 200 to be detachably installed therein. A drain hole 151 is formed on the side of the keeping case 110 and communicating with the drain unit 150. The keeping case 110 is not limited to the cylindrical shape and may be variously modified to fit an object, a location, and the like, where the laundry or the clothes treating apparatus to be kept is installed. Also, the keeping case 110 may further include insertion protrusions 115 and 117 protruding from a lower surface 113 thereof, by which the keeping case 110 may be coupled to an upper surface of a washing machine or a dryer, to a basket in which the laundry is kept, or to an opening of a drum.

In of the configuration described above, the keeping case may be easily installed in a washing machine or a dryer, and the laundry may be effectively washed by using both the clothes treating apparatus including the steam generator according to an exemplary embodiment of the present disclosure and the washing machine or the dryer together. For example, if the laundry is partially contaminated so it is required to be separately processed, the laundry may be put on the tray 120, the contaminated portion may be steamed with the steam generator, and then introduced to the washing machine such that the contaminated portion may be easily washed.

The condensation collecting unit 130 is a water receiving container provided below the tray 120. The condensation collecting unit 130 may be formed to have a plate shape having an open upper surface and a predetermined depth, and inserted into the recess having a substantially fan shape, for example, on an upper surface of the keeping case 110. An edge portion of the condensation collecting unit 130 may have a flange shape, and thus, the condensation collecting unit 130 may be placed on the edge of the cutaway portion of the keeping case 110. That is, the condensation collecting unit 130 may have a substantially fan shape the same as a recess edge having the fan shape so as to be inserted into the recess formed on the upper surface of the keeping case 110. However, the shape or a size of the edge of the condensation collecting unit 130 may be varied according to the shape of the keeping case 110 or the shape of the recess in which the condensation collecting unit is installed. The condensation collecting unit 130 may be insertedly coupled to an upper surface of the keeping case 110, and may be separated from the keeping case 110 for cleaning or other purposes.

A bottom surface 131 of the condensation collecting unit 130 may be formed to be sloped toward the drain hole 151, such that condensation collected by the condensation collecting unit 130 may flow toward the drain hole 151. Also, the condensation collecting unit 130 may have a through hole 133 formed on the side thereof facing the drain hole 151, allowing the interior of the condensation collecting unit 130 to communicate with the drain hole 151. Thus, condensation flowing from an upper portion of the condensation collecting unit 130 toward the bottom surface 131 may be drained to the drain hole 151 through the through hole 133.

In the configuration described above, since condensation generated when steam is jetted to the laundry may be allowed to quickly flow to the drain hole 151, even though the capacity of the condensation collecting unit 130 may be small, condensation may be easily drained without overflowing.

The tray 120 serves to fix the laundry thereon and allow condensation generated when steam is jetted to the laundry to be collected by the condensation collecting unit 130. The tray 120 may have a plate shape with a plurality of through holes 121 formed thereon and allow condensation collected to an upper surface of the tray 120 to drop from the tray through the through holes 121. The tray 120 may be installed to substantially cover the open upper surface of the condensation collecting unit 130. Also, the tray 120 has a fan shape corresponding to the fan shape of the keeping case 110, but the shape of the tray 120 is not limited thereto and the tray may have a container shape extending upwardly from the condensation collecting unit 130 and having a plurality of through holes formed on an upper surface thereof.

The tray 120 may be detachably installed in the condensation collecting unit 130 or the keeping case 110. For example, a protrusion may be formed on an inner surface of the condensation collecting unit 130 and the tray 120 may be installed thereon, or a fixing protrusion or a fixing recess may be formed on an upper surface of the keeping case 110 and the tray 120 may be installed thereon.

The steam generator receiving unit 140 may be formed as a recess having a predetermined depth on an upper surface of the keeping case 110. Here, the predetermined depth may be equal to a height of the steam generator 200. A lower surface of the steam generator receiving unit 140 may have the same shape as that of a silhouette of a lower surface of the steam generator 200 such that the steam generator can be received in the steam generator receiving unit 140. An insertion hole 141 into which a steam jetting unit 230 of the steam generator 200 is inserted may be formed on a lower surface of the steam generator receiving unit 140. Also, the lower surface of the steam generator receiving unit 140 may be formed of a metal to allow a magnet 215 installed on the lower surface of the steam generator 200 to stick thereto or at least a portion of the lower surface of the steam generator receiving unit 140 corresponding to the magnet 215 may be formed of a metal. Through the configuration described above, the steam generator 200 may be stably fixed to and received in the steam generator receiving unit 140.

The drain unit 150 may include a drain pipe as a component for draining condensation introduced to the drain hole 151 outwardly. The drain pipe of the drain unit 150 may extend to a drain of a location where a drainage is present, such as a bathroom, a utility room, and the like.

Although not shown, the keeping case 110 may further include a water storage container for storing water to be supplied to the steam generator 200. For example, a remaining empty space in the keeping case 110 occupied by the condensation collecting unit 130 and the steam generator receiving unit 140 may be the water storage container. In order to supply the water storage container, a cutout hole having an appropriate size may be formed on an upper surface of the water storage container. The water storage container and the steam generator 200 may be connected by a water supply hose such that water from the water storage container may be supplied to the steam generator 200.

The steam generator 200 is a device for heating water to generate steam and jetting the generated steam outwardly. The steam generator 200 includes a steam generating unit, a case in which the steam generating unit is provided, and a steam jetting unit provided in the case and jetting steam generated by the steam generating unit outwardly.

The steam generating unit includes a water accommodation unit 201 and a heater 220 extending along the water accommodation unit 201. The case of the steam generator 200 includes a first case frame 211 having a handle unit 217 formed on an outer surface thereof and a second case frame 212 including the water accommodation unit 201 and the heater 220. The first case frame 211 and the second case frame 212 may be coupled in edge portions thereof to form the case of the steam generating unit, and may be formed of an insulating material such that heat at high temperatures of steam within the heater 220 and the water accommodation unit 201 may not be transmitted to the outside.

The first case frame 211 may include elements that supply power to the steam generator 200 and provide control to generate and jet steam, such as a control unit 251, a power supply unit 253, and the like. The handle unit 217 of the first case frame 211 is formed to be exposed to an upper side of the steam generator receiving unit 140, so that a user may easily grasp the steam generating unit and separate the steam generator 200 from the steam generator receiving unit 140. The power supply unit 253 is a component for supplying power to the heater 220 and the control unit 251. The power supply unit 253 may be provided with power from an external power source by a separate power source terminal 255. The control unit 251 controls an operation of the heater 220. Also, a power button (not shown) may be provided in the first case frame 211. When the user turns on the power button, the control unit 251 may operate the heater 220. Here, the control unit 251 may control the heater 220 to enable the steam jetting unit 230 to jet steam at temperatures ranging from about 30° C. to 50° C.

Figure 4:
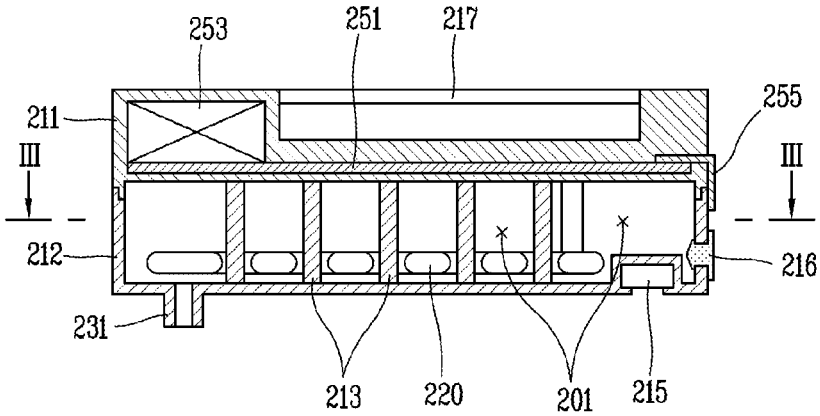
FIG. 4 is a cross-sectional view taken along line II-II of FIG. 3.
Figure 5:
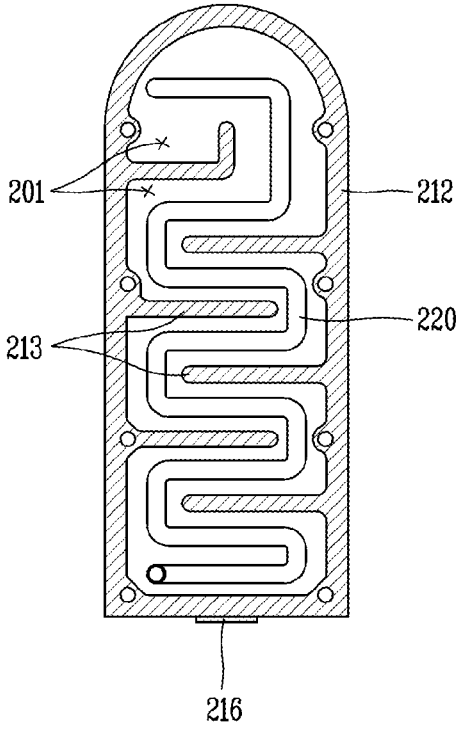
FIG. 5 is a cross-sectional view taken along line III-III of FIG. 4.

The second case frame 212 is an empty case having a predetermined thickness and width, and extending in a direction in which water flows along the water accommodation unit 201. Referring to FIGS. 4 and 5, the second case frame 212 may include a plurality of partitions 213 protruding from one inner side of the frame and extending toward the other inner side facing thereto in order to partition the water accommodation unit 201 to form a flow path in a zigzag pattern. The plurality of partitions 213 are disposed to be spaced apart from one another by a predetermined interval in a lengthwise direction of the second case frame 212. Also, the plurality of partitions 213 protrude alternately from both sides of the second case frame 212 such that end portions of the partitions 213 are spaced apart from the side of the second case frame 212 facing thereto by a predetermined interval, whereby empty spaces between the partitions 213 form a flow path in a zigzag pattern to become the water accommodation unit 201.

A water inlet hole is formed at one end portion of the second case frame 212. The water inlet hole is hermetically closed by a water inlet hole shutoff 216 to prevent water leakage. The water inlet hole shutoff 216 is a shutoff which is detachably inserted, and thus, the user may open the shutoff 216, supply water to the water accommodation unit 201, and insert the shutoff 216 to close the water inlet hole. The water inlet hole is formed on the side of the second case frame 212 to communicate with a space of one end portion of the flow path formed by the partitions 213, namely, the uppermost stream space of the flow path, and the steam jetting unit 230 may be provided on a lower surface of the second case frame 212 to communicate with a space of the other end portion of the flow path formed by the partitions 213, namely, the lowermost stream space of the flow path.

In the present exemplary embodiment, the configuration in which the user directly supplies water to the water accommodation unit 201 is described, but the present disclosure is not limited thereto. The water inlet hole may be provided with water through a water supply hose from the water storage container (not shown) formed in the keeping case 110 as described above. Water supply using the water supply hose may be controlled by the control unit 251. Here, in a state in which the heater 220 is operated, water may be supplied to the water inlet hole. Thus, while water is flowing along the flow path of the water accommodation unit 201, water may be immediately heated by the heater 220 and pressure is increased in a direction toward the lower stream of the water accommodation unit 201 so that the steam jetting unit 230 may jet steam at high pressure.

The magnet 215 is provided on the lower surface of the second case frame 212. As described above, the magnet 215 is a component for stably installing the steam generator 200 in the steam generator receiving unit 140, and here, the steam generator 200 is fixed to the steam generator receiving unit 140 by magnetism. However, the component for installing the steam generator 200 in the steam generator receiving unit 140 is not limited thereto and may use other known means. For example, instead of the magnet 215, a hook may be formed and a recess to be coupled to the hook may be formed on a lower surface of the steam generator receiving unit 140.

The steam jetting unit 230 includes a steam supply flow channel 231 extending from the lower surface of the second case frame 212 outwardly and an injection nozzle 233 provided at the end of the steam supply flow channel 231 to jet steam at a pressure level equal to or higher than a predetermined pressure. The steam supply flow channel 231 communicates with the lowermost stream space of the flow path of the water accommodation unit 201 and steam generated as water, while flowing in the flow path of the water accommodation unit 201, is heated by the heater 220 is introduced to the steam supply flow channel 231.

In order to jet steam at a pressure level equal to or higher than a predetermined pressure, an injection hole 232 of the injection nozzle 233 may have a diameter ranging from about 1 mm to 2 mm. If the diameter of the injection hole 232 is greater than 2 mm, force of steam jetted from the injection nozzle 233 hitting the laundry may be too weak to remove a contaminant. If the diameter of the injection hole 232 is greater than 1 mm, a flow amount of steam will be excessively small and the injection hole may become clogged by a scale.

In order to allow the diameter of the injection hole 232 to be varied according to water pressure, a cut line 235 may be formed on the edge of the injection hole 232. To this end, the injection nozzle 233 may be formed of a flexible material. Even though a scale is formed in the vicinity of the injection hole 232, an injection flow rate equal to or greater than a predetermined level may be secured to discharge a foreign object. However, the injection nozzle 233 is not limited thereto and an injection nozzle without the cut line 235 may also be provided.

Figure 6:
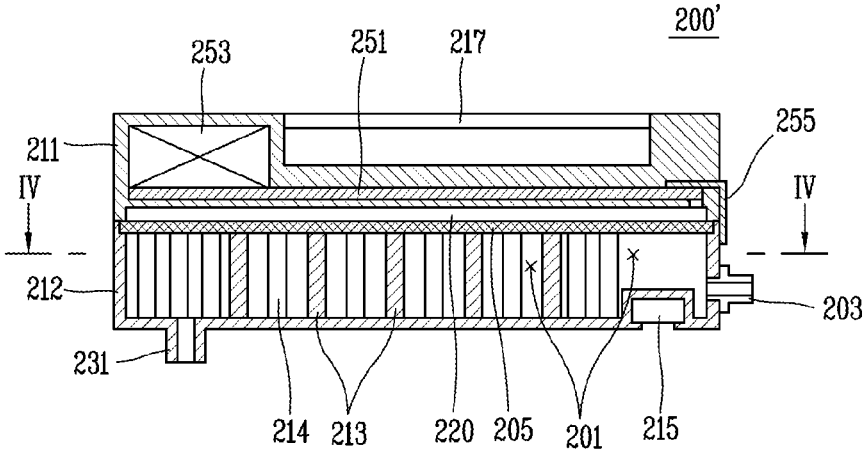
FIG. 6 is a cross-sectional view of another embodiment of a steam generator taken along line II-II.
Figure 7:
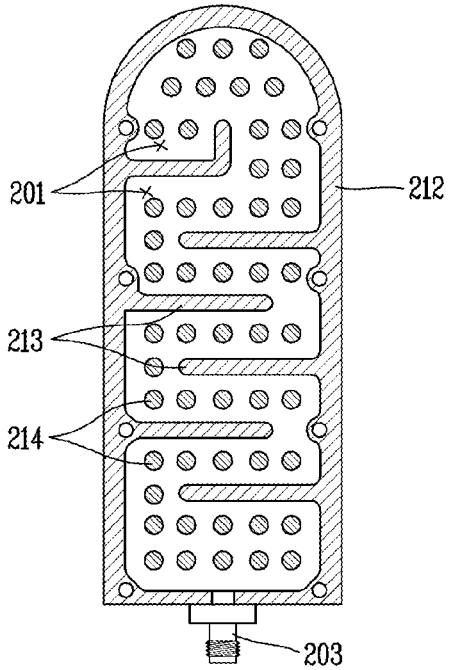
FIG. 7 is a cross-sectional view taken along line IV-IV of FIG. 6.

FIGS. 6 and 7 are cross-sectional views of another embodiment of a steam generator. FIG. 6 illustrates a cross-sectional view of an embodiment 200' of a steam generator viewed in the same direction as that of a direction of II-II of FIG. 3. In the embodiment 200 described above, the heater 220 is disposed to extend along the space of the water accommodation unit 201, but in the present embodiment 200', a plurality of electric heating protrusions 214 are formed in the water accommodation unit 201 and the heater transmits heat to each of the electric heating protrusions 214 by conduction to indirectly heat water. The electric heating protrusions 214 extend from a lower surface of the second case frame 212 to a side facing thereto. Since the plurality of electric heating protrusions 214 are formed to have a rod shape within the flow path of the water accommodation unit 201, a heat transmission area increases. Here, the heater 220 is installed in the second case frame 212 and a heat conduction or transmission plate 205 is provided between the electric heating protrusions 214 and the heater 220 such that the heater 220 may not be directly exposed to water.

In the configuration as described above, since the area in which heat is transmitted to water within the water accommodation unit 201 is increased by the electric heating protrusions 214, steam may be immediately generated while water flows along the flow path, shortening the time for generating steam. Also, since the heater 220 is not provided within the water accommodation unit 201 and generates steam by conducting heat to the heat transmission plate 205 and the electric heating protrusions 214, a separate member for making the heater 220 watertight is not necessary.

The steam generator 200' may further include a water supply hose connection unit 203 to which a water supply hose may be connected to receive water directly from the outside. That is, in the present embodiment 200', the water supply hose connection unit 203, instead of the shutoff 216 in FIG. 4, may be provided. The water supply hose connection unit 203 may have an inner diameter to communicate with the water inlet hole formed in the second case frame 212, and protrudes from the second case frame 212. Also, the water supply hose connection unit 203 may have a thread formed in an exposed end portion thereof in order to facilitate connection with a water supply hose. The water supply hose connection unit 203 may be connected to an external water source or the water storage container (not shown) formed in the keeping case through a water supply hose in order to supply water to the water inlet hole. If necessary, the water supply hose connection unit 203 may be modified to be formed within the side of the second case frame 212.

Figure 8:
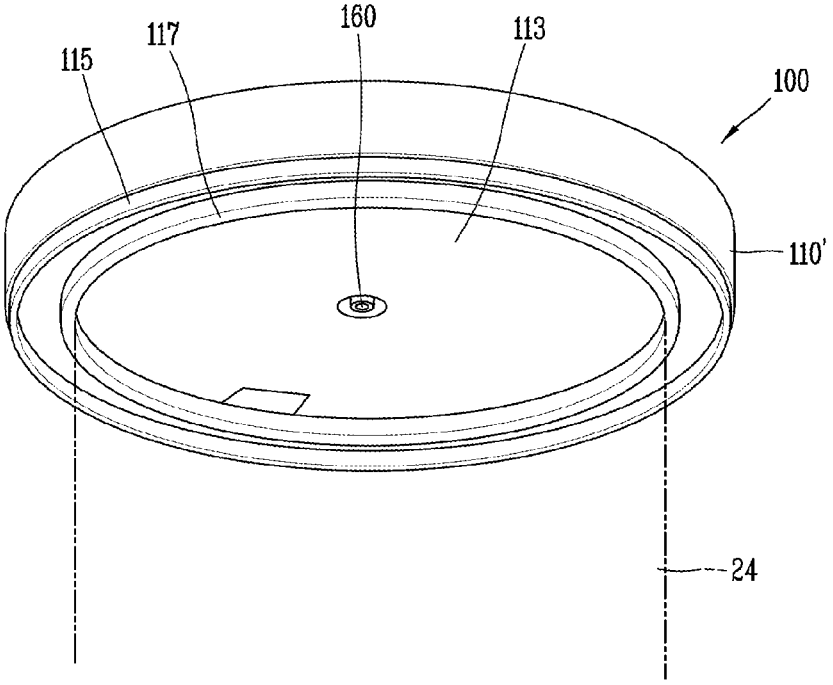
FIG. 8 is a bottom perspective view of a keeping case illustrating a state in which a clothes treating apparatus including a steam generator is installed in a container with the laundry therein, according to the present disclosure.

FIG. 8 is a perspective view illustrating another embodiment 110' of the keeping case described above. The keeping case 110' according to the present embodiment may further include a steam injection pipe 160 extending from the insertion hole 141 to a lower surface 113 of the keeping case. The steam injection pipe 160 may operate the steam generator 200 or 200' to supply steam to the outside even in a state in which the steam generator 200 or 200' is received in the steam generator receiving unit 140.

In the aspect of the configuration described above, although the user does not grasp and manipulate the steam generator 200, steam may be jetted to the laundry. For example, the user may install the clothes treating apparatus including the steam generator in a pot, a basket, or an opening of a tub 24 or a drum, and operate the steam generator 200 or 200' to supply steam to the laundry through the steam injection pipe 160. Thus, the user may place the laundry required to be steam-washed such as the laundry to be boiled, or the like, in a container and install the clothes treating apparatus including the steam generator according to the present disclosure in the container, thus easily performing steam washing. Here, since the plurality of insertion protrusion 115 and 117 are formed in a ring shape on the lower surface 113 of the keeping case as described above, the keeping case may be stably fixed to the opening of the container in which the keeping is intended to be installed.

Figure 9:
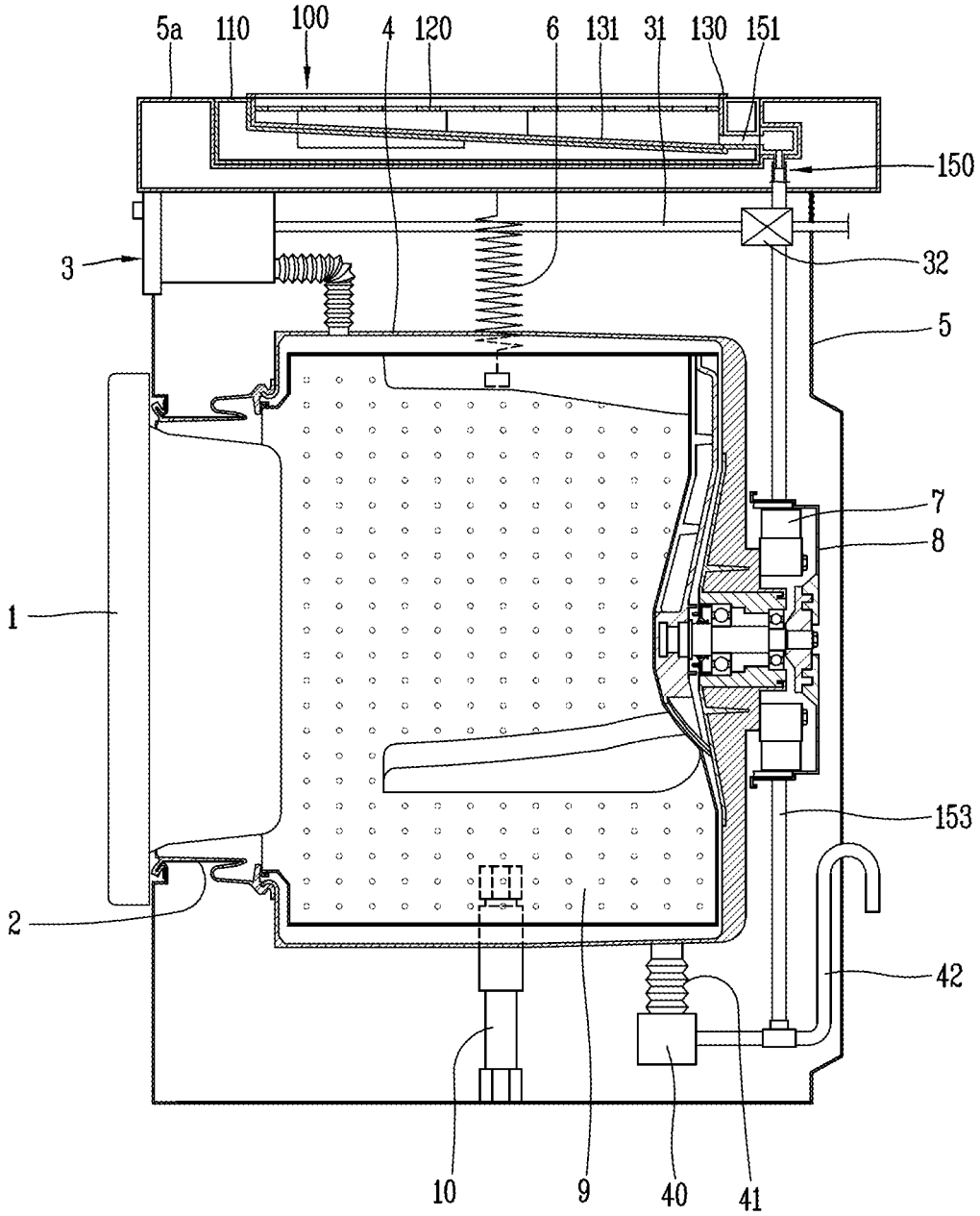
FIG. 9 is a cross-sectional view illustrating another embodiment of a clothes treating apparatus having a steam generator according to the present disclosure.
Figure 10:
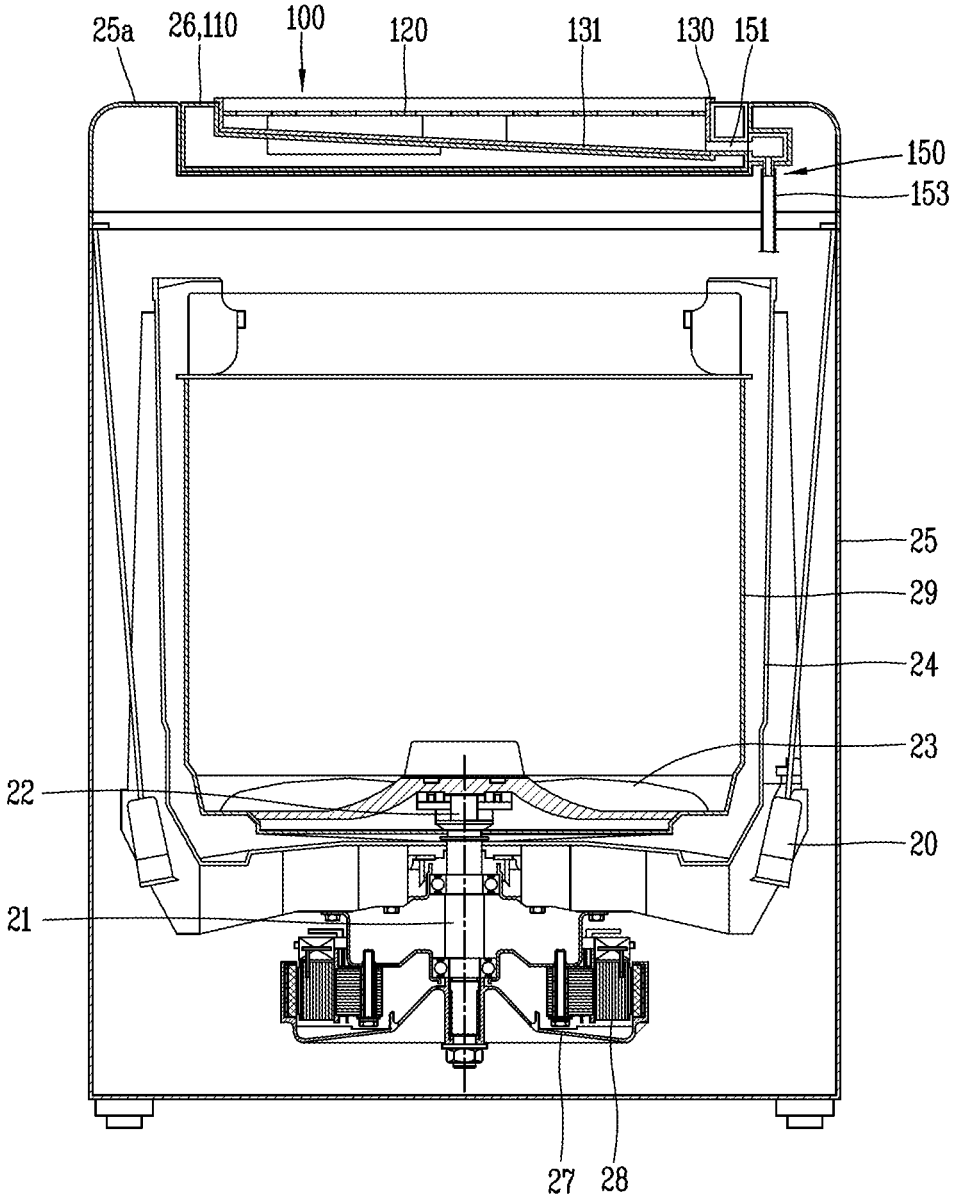
FIG. 10 is a cross-sectional view illustrating another embodiment of a clothes treating apparatus having a steam generator according to the present disclosure.

FIGS. 9 and 10 illustrate embodiments to which a technical concept of the clothes treating apparatus including the steam generator according to the present disclosure is applied. However, the present disclosure is not limited thereto and the technical concept of the present disclosure may also be applied to a washing machine with a dryer or a dryer.

FIG. 9 is a view illustrating an embodiment of a washing machine in which a tub 4 and a drum 9 are open forwardly or from the front. A clothes treating apparatus including a steam generator according to another embodiment of the present disclosure will be described in detail with reference to FIGS. 1 through 9. The washing machine according to the present embodiment includes a cabinet 5, the tub 4 accommodated within the cabinet 5, and a drum 9 rotatably installed within the tub 4.

An opening 2 and a door 1 are provided on the front side of the cabinet 5 to allow the laundry to be inserted or taken out, and the tub 4 is supported by a spring 6 and a damper 10 within the cabinet 5. The tub 4 has a cylindrical shape opened forwardly, and the drum 9 is rotatably installed within the tub 4. The drum 9 has a cylindrical shape in which a front side thereof is open, and a plurality of through holes are formed on a circumferential surface of the drum 9. A plurality of lifts are provided on an inner surface of the drum 9 in order to lift the laundry.

Meanwhile, driving motors 7 and 8 are coupled to a rear side of the tub in order to rotate the drum 9. The driving motors 7 and 8 include a stator 7 and a rotor 8 and deliver rotary power to the drum 9. Drain channels 41 and 42 having a drain pump 40 are provided below the tub 4 in order to drain water. A detergent supply device 3 is provided above the tub 4 in order to supply a detergent. A water supply pipe 31 is connected to the detergent supply device 3. A water supply valve 32 is provided in the water supply pipe 31 to adjust an amount of water supply.

The laundry keeping unit 100 is installed to be received on an upper part 5*a* of the cabinet 5. The keeping case 110 or 110' described above may be appropriately modified to be formed on the upper part 5*a* of the cabinet 5. Specific configurations of the laundry keeping unit 110 and the steam generator 200 or 200' are the same as those of the previous exemplary embodiment described above, and thus, a detailed description thereof will be omitted.

The upper part 5*a* of the cabinet 5 may have a through hole formed on a lower surface thereof to allow the drain unit 150 of the laundry keeping unit to extend to the interior of the cabinet 5. A drain pipe 153 of the drain unit 150 extends to the interior of the cabinet 5 and is connected to the drain channel 42. Also, the water supply hose connection unit 203 of the steam generator is connected to a water supply hole (not shown) diverged from the water supply valve 32 or the water supply pipe 31 to receive water. Here, when the laundry keeping unit 100 is applied to a dryer, a separate water storage container (not shown) is further provided in the keeping case 110 as described above, and the water supply hose connection unit 203 may be connected to the water storage container by a water supply hose.

In the configuration described above, since the laundry keeping unit 100 is connected to the drain line of the washing machine and the steam generator 200 or 200' is connected to the water supply line of the washing machine, drainage and water supply is facilitated. Also, in the present exemplary embodiment, since a clothes treating apparatus in which the steam generator 200 or 200' is installed outside of the washing machine is realized, a locally contaminated portion of the laundry may be appropriately steamed by using the steam generator 200 or 200' and then presented into the washing machine, the laundry may be effectively washed.

FIG. 10 is a view illustrating a washing machine in which a tub 24 and a drum 29 are open upwardly or from the top. A clothes treating apparatus including a steam generator according to another exemplary embodiment of the present disclosure will be described in detail. This embodiment includes a cabinet 25 forming an outer appearance, and a tub 24 is provided within the cabinet 25. A drum 29 rotated by driving motors (27 and 28) is provided within the tub 24. A washing blade 23 is provided on a bottom surface of the drum 29, and rotated by the driving motors (27 and 28).

The driving motors (27 and 28) forming rotary power for rotating the drum 29 and the washing blade 23 are provided below the tub 24, and include a rotor 27 and a stator 28. The drum 29 receives rotary power from the driving motors (27 and 28) by means of a spin-dry shaft 21, and the washing blade 23 receives rotary power from the driving motors (27 and 28) by means of a washing shaft 22. The spin-dry shaft 21 and the washing shaft 22 are coaxially installed, and the washing shaft 22 is positioned within the spin-dry shaft 21. The spin-dry shaft 21 and the washing shaft 22 are rotatably supported by a bearing housing. Vibrations generated when the drum 29 or the washing blade 23 rotate are buffered by a plurality of dampers 20 provided between the tub 24 and the cabinet 25.

An opening is formed on an upper surface 25*a* of the cabinet 25 to allow the laundry to be introduced into the drum 29, and a door 26 is installed on the upper surface of the 25*a* to open and close the opening. The laundry keeping unit 100 is installed such that it is received in the door 26. Also, the foregoing keeping case 110 or 110' may be appropriately modified in shape so as to be formed as the door 26. Here, the drain unit 150 is formed in a hinge unit of the door 26, and a drain pipe 153 of the drain unit 150 extends to the interior of the cabinet 25 from the upper surface 25*a* of the cabinet 25. Similar to that of the previous exemplary embodiment described above, the drain pipe 153 is connected to a drain line within the washing machine. Also, although not shown, a water supply hose is diverged from a water supply line within the washing machine and connected to the water supply hose connection unit 203.

However, when the laundry keeping unit is applied to a dryer, a separate water storage container (not shown) may be further formed in the keeping case 110, and the water supply hose connection unit 203 may be connected to the water storage container by a water supply hose. The drain pipe 153 may extend from the upper surface 25*a* of the cabinet 25 to the outside such that condensation may be immediately drained.

Specific configurations of the laundry keeping unit 100 and the steam generator 200 or 200' are the same as those of the previous exemplary embodiment described above, and thus, a detailed description thereof will be omitted.

In the configuration described above, since the laundry keeping unit 100 is connected to the drain line within the washing machine and the steam generator 200 or 200' is connected to the water supply line of the washing machine, drainage and water supply may be facilitated. Also, in a case in which the door 26 such as in the keeping case 110' according to the modified exemplary embodiment of the present disclosure described above with reference to FIG. 10 is formed, steam may be jetted directly to the drum 29 by the steam injection pipe 160.

Also, in the present exemplary embodiment, since a clothes treating apparatus in which the steam generator 200 or 200' is installed outside of the washing machine is realized, a locally contaminated portion of the laundry may be appropriately steamed by using the steam generator 200 or 200' and then introduced into the washing machine. Thus, the laundry may be move effectively washed.

According to an exemplary embodiment of the present disclosure, the laundry may be locally steamed. Also, according to an exemplary embodiment of the present disclosure, the steam generator may be installed in various objects to supply steam.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus comprising:

a cabinet;

a drum rotatably installed within the cabinet;

a driving unit for driving the drum;

a water supply unit for supplying washing water to the drum;

a draining unit for draining washing water from within the drum;

a laundry keeping unit detachably installed on an upper surface of the cabinet; and a steam generator provided outside of the cabinet and configured to jet steam to laundry supported by the laundry keeping unit, the steam generator having a handle unit formed on an outer surface thereof, wherein the laundry keeping unit includes:

a keeping case having an upper opening and detachably disposed on the upper surface of the cabinet;

a tray having a plate shape with a plurality of through holes to penetrate condensate generated from laundry disposed on an upper surface thereof, the tray disposed on the upper opening of the keeping case;

a condensation collecting unit disposed below the tray in the keeping case, the condensation collecting unit receiving the condensate from the tray; and a steam generator receiving unit formed on an upper surface of the keeping case to allow the steam generator to be detachably received, wherein the keeping case includes insertion protrusions protruding from a lower surface of the keeping case so that the keeping case couples to the upper surface of the cabinet, and wherein the handle unit of the steam generator is formed to be exposed to an upper side of the steam generator receiving unit to grasp and separate the steam generator from the steam generator receiving unit.

2. The clothes treating apparatus of claim 1, wherein the laundry keeping unit further comprises:

a drain unit communicating with the condensation collecting unit, wherein the drain unit is connected to the draining unit.

3. The clothes treating apparatus of claim 1, wherein the steam generator comprises:

a steam generating unit having a space for accommodating water and including a heater to heat water to generate steam;

a case including the steam generating unit; and a steam injecting unit in the case and communicating with the steam generating unit to jet steam.

4. The clothes treating apparatus of claim 3, wherein the water supply unit comprises:

a water supply hose extending outside of the cabinet to supply water to the steam generating unit.

5. A clothes treating apparatus comprising:

a laundry keeping unit including a keeping case having an upper opening, the case detachably disposed on an upper opening of a container accommodating laundry therein;

a tray having a plate shape with a plurality of through holes to penetrate condensate generated from laundry disposed on an upper surface thereof, the tray disposed on the upper opening of the keeping case;

a steam generator receiving unit formed on an upper surface of the keeping case to allow the steam generator to be detachably received, and a steam generator detachably installed in the laundry keeping unit and configured to jet steam to the tray, the steam generator having a handle unit formed on an outer surface thereof, wherein the keeping case includes insertion protrusions protruding from a lower surface of the keeping case so that the keeping case couples to a basket in which the laundry is kept, and wherein the handle unit of the steam generator is formed to be exposed to an upper side of the steam generator receiving unit to grasp and separate the steam generator from the steam generator receiving unit.

6. The clothes treating apparatus of claim 5, wherein the steam generator comprises:

a steam generating unit having a space for accommodating water and including a heater to heat water to generate steam;

a case including the steam generating unit; and a steam injecting unit in the case and configured to communicate with the steam generating unit to jet steam.

7. The clothes treating apparatus of claim 5, further comprising:

a condensation collecting unit below the tray in the keeping case, the condensation collecting unit receiving the condensate from the tray.

8. The clothes treating apparatus of claim 5, wherein the steam generator includes an injection nozzle, and wherein the steam generator receiving unit has an insertion hole, the insertion hole receiving the injection nozzle of the steam generator.

9. The clothes treating apparatus of claim 8, wherein the laundry keeping unit further comprises:

a steam injection pipe configured to communicate with the insertion hole and to extend from the insertion hole to a lower surface of the laundry keeping unit through the laundry keeping unit.

10. A clothes treating apparatus comprising:

a cabinet;

a drum rotatably installed within the cabinet;

a driving unit configured to rotatably drive the drum;

a water supply unit configured to supply washing water to the drum;

a draining unit configured to drain washing water from within the drum; and a laundry keeping unit installed on the cabinet and the laundry keeping unit including a keeping case having an upper opening and detachably disposed on an upper surface of the cabinet;

a tray having a plate shape with a plurality of through holes to penetrate condensate generated from laundry disposed on an upper surface thereof, the tray disposed on the upper opening of the keeping case; and a steam generator provided outside of the cabinet and configured to jet steam to laundry supported by the laundry keeping unit, the steam generator having a handle unit formed on an outer surface thereof, wherein the laundry keeping unit further comprises a steam generator receiving unit formed on an upper surface of the keeping case to allow the steam generator to be detachably received, wherein the keeping case includes insertion protrusions protruding from a lower surface of the keeping case so that the keeping case couples to the upper surface of the cabinet, and wherein the handle unit of the steam generator is formed to be exposed to an upper side of the steam generator receiving unit to grasp and separate the steam generator from the steam generator receiving unit.

11. The clothes treating apparatus of claim 10, wherein the laundry keeping unit further comprises:

a condensation collecting unit installed below the tray.

12. The clothes treating apparatus of claim 11, wherein the laundry keeping unit further comprises:

a drain unit configured to communicate with the condensation collecting unit, wherein the drain unit is connected to the draining unit.

13. The clothes treating apparatus of claim 10, wherein the steam generator comprises:

a steam generating unit having a space for accommodating water and including a heater to heat water to generate steam;

a case including the steam generating unit; and a steam injecting unit provided in the case and configured to communicate with the steam generating unit to jet steam.

14. The clothes treating apparatus of claim 13, wherein the water supply unit comprises:

a water supply hose configured to extend outside of the cabinet to supply water to the steam generating unit.

* * * * *